US011079147B2

(12) United States Patent
Sanhaji

(10) Patent No.: US 11,079,147 B2
(45) Date of Patent: Aug. 3, 2021

(54) METHOD FOR LOADING REFRIGERANT IN AN AIR CONDITIONING SYSTEM

(71) Applicant: SNAP-ON CLIMATE SOLUTIONS S.R.L., Correggio (IT)

(72) Inventor: Rahhali Sanhaji, Sesto Fiorentino (IT)

(73) Assignee: SNAP-ON CLIMATE SOLUTIONS S.R.L., Correggio (IT)

( * ) Notice: Subject to any disclaimer, the term of this patent is extended or adjusted under 35 U.S.C. 154(b) by 145 days.

(21) Appl. No.: 15/577,608

(22) PCT Filed: May 23, 2016

(86) PCT No.: PCT/IB2016/053019
§ 371 (c)(1),
(2) Date: Nov. 28, 2017

(87) PCT Pub. No.: WO2016/193857
PCT Pub. Date: Dec. 8, 2016

(65) Prior Publication Data

US 2018/0164008 A1 Jun. 14, 2018

(30) Foreign Application Priority Data

May 29, 2015 (IT) ..... 102015000019337

(51) Int. Cl.
*F25B 45/00* (2006.01)
*F25B 49/02* (2006.01)

(52) U.S. Cl.
CPC ..... *F25B 45/00* (2013.01); *F25B 49/022* (2013.01); *F25B 2345/001* (2013.01); *F25B 2345/003* (2013.01); *F25B 2345/006* (2013.01); *F25B 2345/007* (2013.01); *F25B 2500/19* (2013.01); *F25B 2700/19* (2013.01)

(58) Field of Classification Search
CPC ..... F25B 2345/003; F25B 45/00; F25B 2345/00; F25B 2345/007
See application file for complete search history.

(56) References Cited

U.S. PATENT DOCUMENTS

| | | | | |
|---|---|---|---|---|
| 8,497,526 | B2 * | 7/2013 | Vashchenko | H01L 27/0262 257/119 |
| 2002/0112490 | A1 * | 8/2002 | Gong | F25B 45/00 62/149 |
| 2004/0174114 | A1 * | 9/2004 | Ohishi | H01J 29/085 313/495 |
| 2006/0137366 | A1 * | 6/2006 | Kang | F25B 45/00 62/149 |
| 2009/0126375 | A1 * | 5/2009 | Toyoshima | F25B 45/00 62/77 |

(Continued)

OTHER PUBLICATIONS

International Search Report dated Oct. 6, 2016, issued to International Application No. PCT/IB2016/053019.

*Primary Examiner* — Edward F Landrum
*Assistant Examiner* — Alexis K Cox
(74) *Attorney, Agent, or Firm* — Stein IP, LLC

(57) ABSTRACT

A method for loading refrigerant fluid into an A/C system from an apparatus for recovering and regenerating refrigerant fluid includes a step of hydraulically connecting the apparatus with the A/C system by a high pressure pipe and a low pressure pipe and a step of loading refrigerant fluid present in a storage container of the apparatus into the A/C system.

8 Claims, 4 Drawing Sheets

(56) References Cited

U.S. PATENT DOCUMENTS

| | | | | |
|---|---|---|---|---|
| 2011/0000234 | A1* | 1/2011 | Nishimura | F25B 49/005 62/77 |
| 2012/0031116 | A1* | 2/2012 | McMasters | F25B 45/00 62/77 |
| 2013/0312434 | A1 | 11/2013 | Sanhaji | 62/77 |
| 2014/0174114 | A1 | 6/2014 | Tamaki et al. | 62/129 |

* cited by examiner

METHOD FOR LOADING REFRIGERANT IN AN AIR CONDITIONING SYSTEM

CROSS-REFERENCE TO RELATED APPLICATIONS

This application is a national stage of International Application No. PCT/IB2016/053019, filed May 23, 2016 which claims the benefit of priority to Italian Application No. 102015000019337, fled May 29, 2015, in the World Intellectual Property Organization, the disclosures of which are incorporated herein in their entireties by reference.

DESCRIPTION

Field of the Invention

The present invention relates to the field of regenerating refrigerant in an air conditioning (A/C) system.

In particular, the invention relates to a method for loading regenerated refrigerant in the A/C system itself.

Description of the Prior Art

As is well known, the refrigerant present in A/C systems, in particular those on board vehicles such as cars, is periodically recovered and recycled to eliminate impurities accumulated during an operating cycle.

A type of apparatus used for recovering and regenerating refrigerant is described, for example, in EP1367343A1 or in PI2012A000067.

In particular, this type of apparatus provides hydraulically connecting lines of the A/C system, one with low-pressure refrigerant and one with high-pressure refrigerant, to two connection pipes of the apparatus, thus allowing recovery of the refrigerant. The refrigerant aspirated from pipes arrives, through a feeding pipe, to a purification unit, comprising a separator/heater, a compressor and a condenser. The refrigerant condensed and purified after the regenerating process is accumulated in a storage container. Finally, at the end of a vacuum phase of the A/C system, the refrigerant reenters the A/C system through the pipes, exploiting the pressure difference between the regenerating apparatus and the A/C system.

In more detail, during the loading phase of the refrigerant in the A/C system, a load cell monitors the loss of weight of the storage container, allowing the calculation of the refrigerant that is dispersed, in order to adjust the opening of the valves of the connection pipes and then the flowrate of the outlet refrigerant. Once the weight of refrigerant that is used for filling the A/C system is released from the storage container, the refill is stopped and the valves are closed.

Concerning the amount of refrigerant to be refilled, in the last few years, car producers remarkably reduced the amount of refrigerant used in A/C systems, in order to reduce waste and production costs, while maintaining the same performance. In the late 1990s. A/C systems, for example, used an amount of refrigerant of about 900 g with a tolerance of refill of about 50 g set by rules. Instead, currently, an A/C system of the same kind requires about 350 g of refill with a tolerance of about 15 g, as provided by regulations that control the treatment of refrigerants and the procedure for their recovery and refilling in an A/C system, for example by regulations SAE J2788 and SAE J2843.

Despite the fact that the amount and the tolerance of filling are already very low, the current tendency is to further reduce the amount of refrigerant and therefore the tolerances provided for its refilling. It is then presumed that the amount of refrigerant and the tolerance fall further below the 350 g and 15 g, respectively.

There are, however, difficulties in complying with a tolerance so low, for machines presently used, due to the amount of refrigerant that remains in the connection pipes between the apparatus for recovering and regenerating the refrigerant and the A/C system. The connection pipes, in particular, have an average length between 2 and 3 m and have an inner diameter between 4 and 5 mm.

The amount of gas that remains in the connection pipes is generally between 20 g and 80 g, and varies with the current pressure of the A/C system, the status and spatial configuration of the pipes, and the external temperature.

Therefore, because it is impossible to verify the content of the connection pipes, it is also impossible to know how much of the refrigerant that left the storage container has reached the A/C system.

Currently, an effective method used to solve this problem includes causing the compressor of the A/C system to aspirate the entire amount of refrigerant that remains in the connection pipes, gradually creating a vacuum inside them.

This step, however effective, is rather difficult and requires time and attention of operators, in addition to having to keep the motor of the vehicle turned on for the entire time of the step, causing noise, pollution and energy consumption.

Furthermore, with the introduction of the refrigerant HFO 1234yf, a flammable gas, putting the A/C system into operation during the recovery, regenerating and refilling steps is no longer allowed for safety reasons, and this leads to the need to face in a different way the problem of verification of the filling and of the residual refrigerant in the connection pipes.

On the other hand, the tight tolerances of refilling do not allow avoidance of the step of verifying the filling, using the sole weight reading of refrigerant discharged from the reservoir, for the reasons described above.

SUMMARY OF THE INVENTION

It is therefore a feature of the present invention to provide a method of loading refrigerant in an A/C system that allows for meeting the tight tolerances provided by regulations in force.

It is also a feature of the present invention to provide such a method that ensures the refrigerant is not dispersed into the external environment.

These and other objects are achieved by a method for loading refrigerant in an A/C system from an apparatus for recovering and regenerating refrigerant, comprising the steps of

- hydraulically connecting the apparatus with the A/C system through a high pressure pipe and a low pressure pipe;
- loading the refrigerant present in a storage container of the apparatus into the A/C system;
- wherein the loading step comprises the steps of:
- measuring an initial amount of refrigerant $P_0$ present in the storage container:
- setting a value B of the amount of refrigerant total to be loaded into the A/C system;
- loading into the A/C system, through the high pressure pipe and/or the low pressure pipe, an amount of refrigerant in liquid phase equal to B−x, wherein x is a predetermined quantity;

calculating a value B* by the equation B*=B+m, wherein m is a quantity that can be positive, negative or null, the absolute value of m being less than the absolute value of B;

further loading, for a number i of cycles, where i=1, 2, . . . , n, quantities $\alpha_i$ of refrigerant, by the steps of:

measuring the actual amount of refrigerant $P_i$ present in the storage container at the i-th cycle;

determining by subtraction a value $T_i=P_0-P_i$, where $T_i$ is the overall amount of refrigerant discharged from the storage container as of the i-th cycle;

calculating a quantity $\alpha_i$ by the equation $\alpha_i=B^*-T_i$;

loading into the A/C system an amount of refrigerant in liquid phase equal to $\alpha_i/2$ through the high pressure pipe and/or the low pressure pipe;

the further loading ending when $\alpha_i$ becomes less than a predetermined value ε.

The method according to the present invention allows for loading tolerances of the refrigerant to be very tight, since it proceeds by repeating steps evaluating instant-by-instant the conditions of loading.

In particular, m can be calculated as a function of the average difference of pressure $DP_{average}$ between the pressure in the storage container and the pressure in the A/C system or as a function of the average mass flowrate $DP_{average}$ of refrigerant during the loading of the amount of refrigerant B−x into the A/C system.

This reduces the uncertainties in managing the refrigerant to be loaded.

In a first embodiment, the quantity m is a function of the average difference of pressure $DP_{average}$ between the pressure in the storage container and the pressure in the A/C system.

In particular, the quantity m is a function of the average difference of pressure $DP_{average}$ according to the following law:

if $DP_{average}<1$ bar, then 8 g<m<12 g;

if 1 bar≤$DP_{average}<2$ bar, then 1 g<m<5 g; and if $DP_{average}\geq 2$ bar, then −4 g<m<0.

Alternatively, the quantity m is a function of the average mass flowrate $DM_{average}$ of refrigerant during the loading of the amount of refrigerant B−x.

In particular, value m is a function of the average mass flowrate $DM_{average}$ according to the following law:

if $DM_{average}<535$ g/minute, then 8 g<m<12 g;

if 535 g/minute≤$DM_{average}<1070$ g/minute, then 1 g<m<5 g; and if $DM_{average}\geq 1070$ g/minute, then −4 g<m<0.

Advantageously, before the step of repeating, a step is provided of sending an amount $V_1$ of refrigerant in gaseous phase through the low pressure pipe towards the A/C system, in order to push the refrigerant in liquid phase present in the low pressure pipe towards the A/C system.

Advantageously, after the loading step of refrigerant in liquid phase, a step is provided of sending an amount $V_2$ of refrigerant in gaseous phase through the high pressure pipe towards the A/C system, in order to push towards the refrigerant in liquid phase present in the high pressure pipe towards the A/C system.

BRIEF DESCRIPTION OF THE DRAWINGS

Further characteristics and/or advantages of the present invention are clearer with the following description of an exemplary embodiment thereof, exemplifying but not limitative, with reference to the attached drawings in which.

DESCRIPTION OF A PREFERRED EXEMPLARY EMBODIMENT

Figure 1:
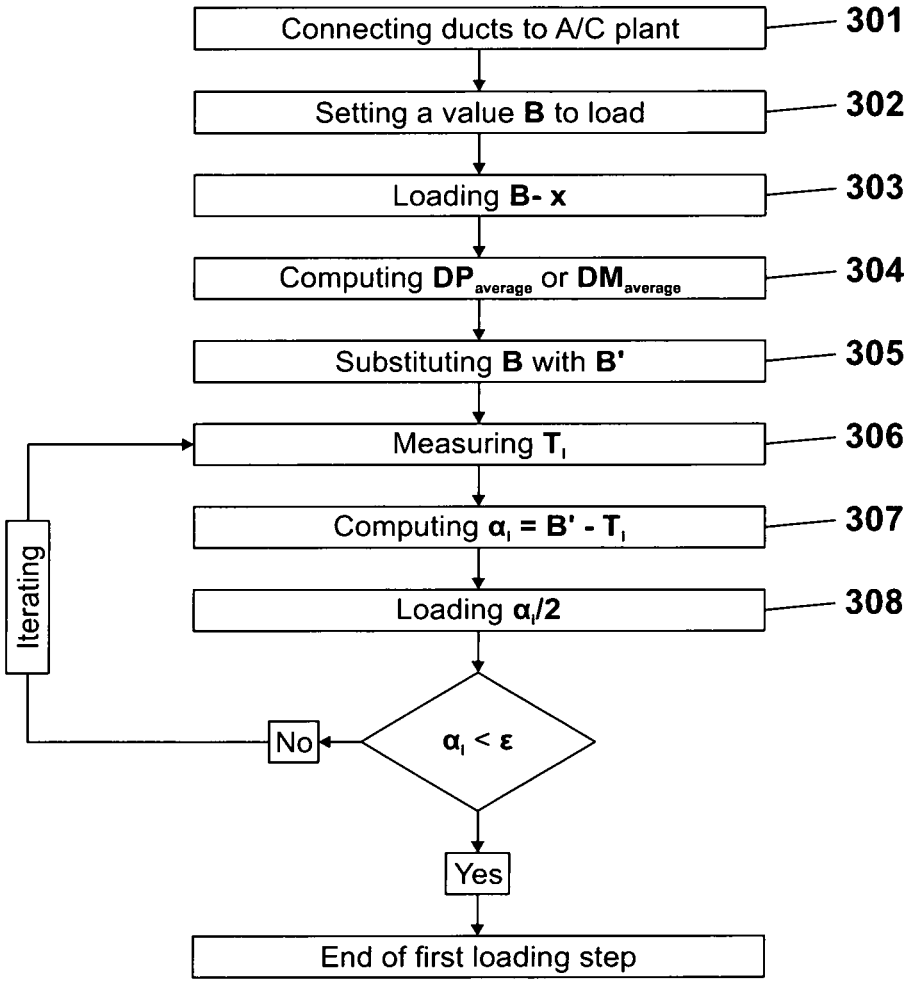
FIG. 1 shows a flowchart of the method for loading refrigerant into an A/C system according to the present invention.
Figure 2:
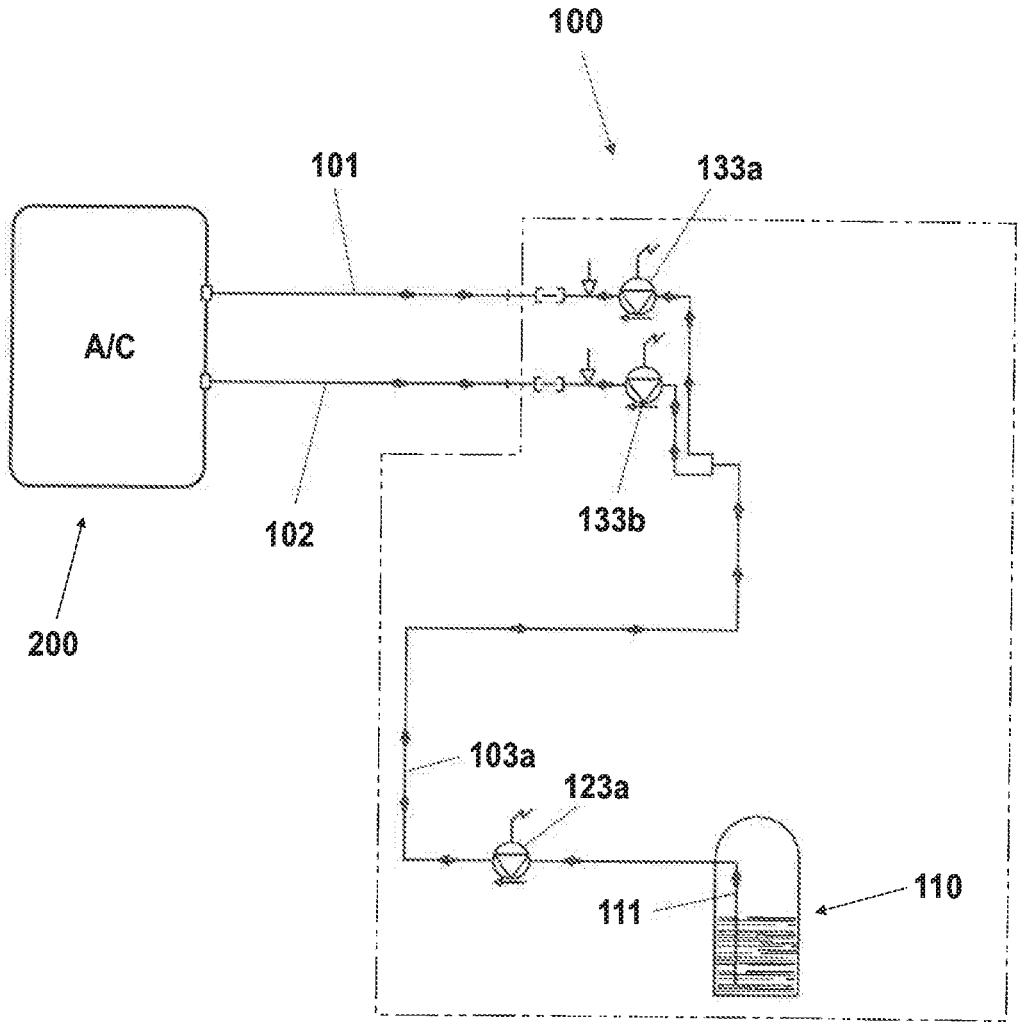
FIG. 2 shows a possible hydraulic connection between a storage container and an A/C system during the loading of refrigerant into the A/C system, according to the method of FIG. 1.

With reference to FIGS. 1 and 2, a method for loading refrigerant into an A/C system 200 from an apparatus with a storage container 110 for recovering and regenerating refrigerant 100, according to the present invention, provides a first step (301) of connecting the pipes 101 and 102 to the A/C system 200. In particular, the high pressure pipe 101 is connected to the A/C system 200 at a line where the refrigerant has higher pressure, whereas the low pressure pipe 102 is connected to a line where the refrigerant has lower pressure.

The method then provides a step (302) of setting a value B of a total amount of refrigerant to load from the storage container 110 into the A/C system 200.

A step (303) is then provided where the valve 123*a*, the valve 133*a* and/or the valve 133*b* are open and the refrigerant in liquid phase is drawn by the storage container 110 through a dip tube 111. The refrigerant is loaded into the A/C system 200, through the pipe 103*a* and one of the pipes 101 and 102, or both. The amount of refrigerant removed from the storage container 110 is determined by a load cell and the valves 133*a* and 133*b* are closed when an amount of refrigerant equal to B−x has been removed, where x is a predetermined parameter. Advantageously, the value of x is set between 40 g and 80 g.

Then, a step is provided (305) where a value B* is calculated by the equation B*=B+m, wherein m is a quantity that can be positive, negative or null, the absolute value of m being less than the absolute value of B.

In particular, m can be calculated as a function of one of the following parameters:

the average difference of pressure $DP_{average}$ between the pressure in the storage container 110 and the pressure in the A/C system 200;

the average mass flowrate $DM_{average}$ of refrigerant during the loading of the amount of refrigerant B−x into the A/C system 200.

This way, the value B* can be related to the instantaneous speed at which the refrigerant is loaded into the A/C system. This reduces the uncertainties in managing the refrigerant to be loaded, since the higher the speed, then the larger the uncertainty is in measuring the amount of refrigerant loaded and, therefore, the lower the value B* has to be.

In a first embodiment, in order to compute B*, a step is provided (304) before the step (305) where the average pressure difference $DP_{average}$ between the pressure in the storage container 110 and the pressure in the A/C system 200 is calculated.

In particular, m, and therefore B*, is a function of $DP_{average}$ according to the following law:

if $DP_{average}$<1 bar, then 8 g<m<12 g;

if 1 bar≤$DP_{average}$<2 bar, then 1 g<m<5 g; and if $DP_{average}$≥2 bar, then −4 g<m<0.

Alternatively, in a second embodiment, it is possible to calculate m as a function of the average mass flowrate $DM_{average}$ of refrigerant during the loading of the amount of refrigerant B−x into the A/C system 200.

In this case, m is a function of $DM_{average}$ according to the following law:

if $DM_{average}$<535 g/minute, then 8 g<m<12 g;

if 535 g/minute≤$DM_{average}$<1070 g/minute, then 1 g<m<5 g; and if $DM_{average}$≥1070 g/minute, then −4 g<m<0.

A step of further loading, for a number i of cycles, where i=1, 2, . . . , n, quantities $\alpha_i$ of refrigerant, comprises:

measuring the actual amount of refrigerant $P_i$ present in the storage container 110 at the i-th cycle and determining by subtraction a value $T_i=P_0-P_i$, where $T_i$ is the overall amount of refrigerant discharged from the storage container 110 as of the i-th cycle (306);

calculating a quantity $\alpha_i$ by the equation $\alpha_i=B^*-T_i$ (307);

loading into the A/C system 200 an amount of refrigerant in liquid phase equal to $\alpha_i/2$ through the high pressure pipe 101 and/or through the low pressure pipe 102 (308).

The further loading goes on until $\alpha_i$ is higher than a predetermined value ε, for example, between 2 g and 10 g.

This way, the refrigerant loaded into the A/C system 200 is monitored at each repeating cycle, to ensure staying within the tolerances required by regulations.

Figure 3:
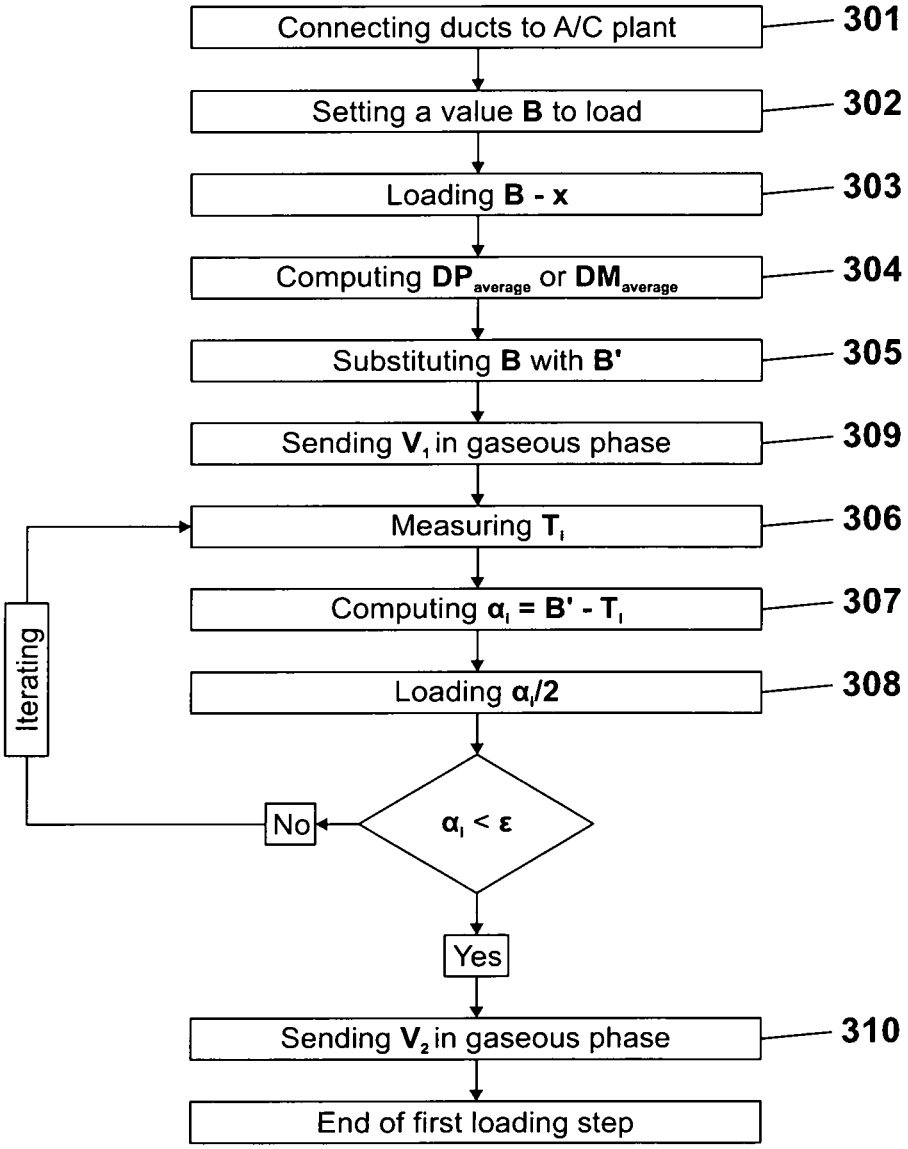
FIG. 3 shows a variant of the method shown in FIG. 1, wherein two further steps are provided of loading refrigerant in gaseous phase into the A/C system.
Figure 4:
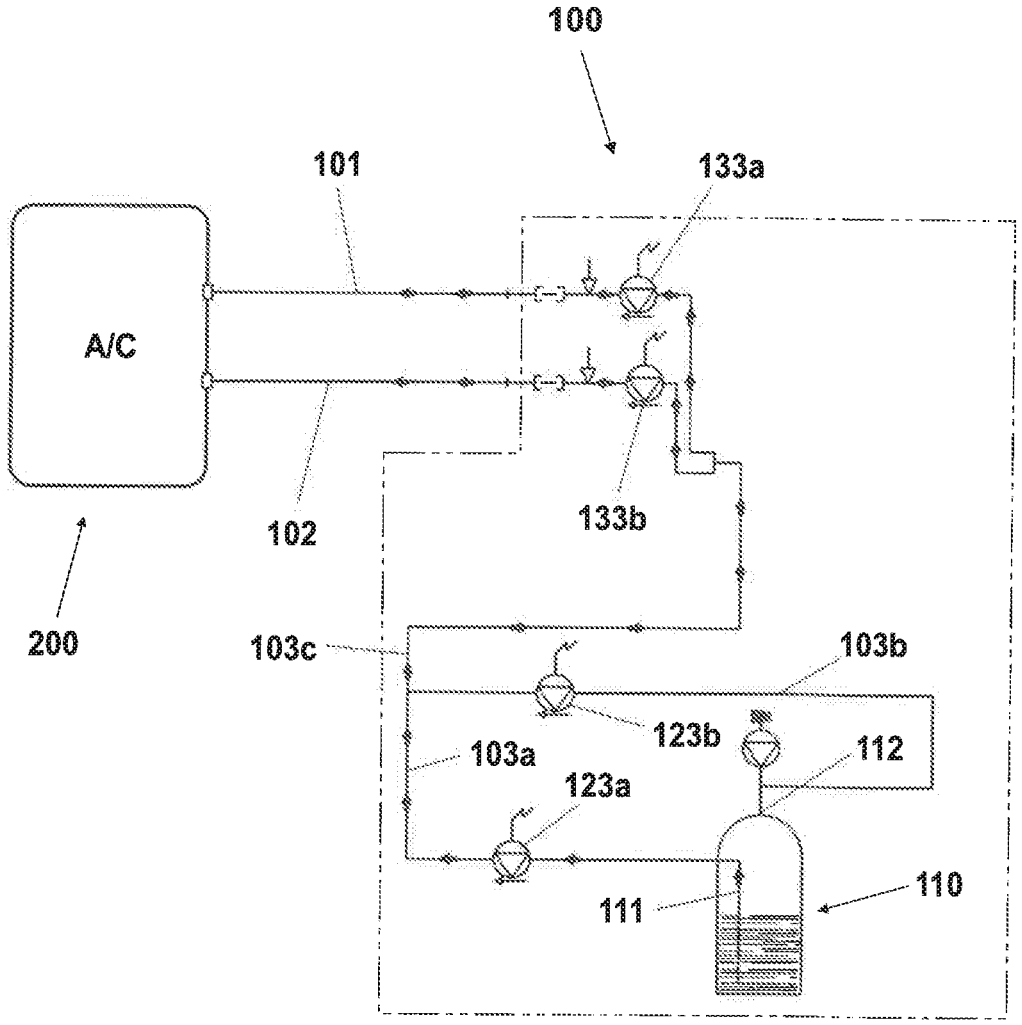
FIG. 4 shows a possible hydraulic connection between the storage container and the A/C system during the loading of refrigerant according, to the method of FIG. 3.

With reference to FIGS. 3 and 4, an exemplary implementation of the method above described provides the introduction of two steps of sending refrigerant in vapor phase to push the refrigerant in liquid phase present in the pipes 101 and 102 towards the A/C system 200.

In particular, a first step (309), before the further loading step, provides the opening of the valves 123*b* and 133*b*. This way, through an opening 112 which is located in the upper part of the container 110, an amount $V_1$ of refrigerant in gaseous phase comes out because of the pressure difference. This amount of refrigerant $V_1$ crosses the pipes 103*b* and 103*c* to reach the low pressure pipe 102, which is emptied of the liquid phase refrigerant present. For example, the amount $V_1$ can be about 10 g.

During the repeating step, the valves 123*b* and 133*b* are closed and the valves 123*a* and 133*a* are open, in such a way that the refrigerant in liquid phase arrives at the A/C system 200 through the pipes 103*a* and 103*c* and the high pressure pipe 101.

At the end of the repeating step, there is then a further step (310) in which the valve 123*a* is closed and the valve 123*b* is opened that makes it possible for an amount $V_2$ of refrigerant in gaseous phase to cross the pipes 103*b* and 103*c* and reach the high pressure pipe 101, which is emptied by the refrigerant accumulated during the repeating step.

If the valves 133*a* and 133*b* are manual, the steps (309, 310) are grouped in a single step that provides the opening of the valves 133*a*, 133*b* and 123*b*, allowing an amount $V_3$ of refrigerant in gaseous phase to cross the pipes 103*b* and 103*c* and reach the pipes of high and low pressure 101 and 102, which are emptied of the liquid refrigerant accumulated during the repeating step.

The foregoing description some exemplary specific embodiments will so fully reveal the invention according to the conceptual point of view, so that others, by applying current knowledge, will be able to modify and/or adapt in various applications the specific exemplary embodiments without further research and without parting from the invention, and, accordingly, it is meant that such adaptations and modifications will have to be considered as equivalent to the specific embodiments. The means and the materials to realize the different functions described herein could have a different nature without, for this reason, departing from the field of the invention, it is to be understood that the phraseology or terminology that is employed herein is for the purpose of description and not of limitation.

The invention claimed is:

1. A method of loading refrigerant into an A/C system from an apparatus for recovering and regenerating the refrigerant, the method comprising the steps of:

hydraulically connecting the apparatus with the A/C system through a high pressure pipe and a low pressure pipe;

loading the refrigerant present in a storage container of the apparatus into the A/C system;

wherein the loading step comprises:

measuring an initial amount of refrigerant $P_0$ present in the storage container;

setting a value B of an amount of total refrigerant to be loaded into the A/C system;

loading into the A/C system, through the high pressure duct and/or the low pressure duct, an amount of refrigerant in liquid phase equal to B−x, wherein x is a predetermined quantity;

calculating a value by the equation B*=B+m, wherein m is a quantity that is positive, negative or null, the absolute value of m being less than the absolute value of B;

further loading, for a number i of cycles, where i=1, 2, . . . , n, quantities $\alpha_i$ of refrigerant, comprising the steps of:

measuring an actual amount of refrigerant $P_i$ present in the storage container at the i-th cycle;

determining by subtraction a value $T_i=P_0-P_i$, where $T_i$ is an overall amount of refrigerant discharged from the storage container as of the i-th cycle;

calculating a quantity $\alpha_i$ by the equation $\alpha_i=B^*-T_i$;

loading into the A/C system an amount of refrigerant in liquid phase equal to $\alpha_i/2$ through the high pressure pipe and/or the low pressure pipe;

the further loading ending when $\alpha_i$ becomes less than a predetermined value ε.

2. The method according to claim 1, wherein the quantity m is a function of an average difference of pressure $DP_{average}$ between a pressure in the storage container and a pressure in the A/C system.

3. The method according to claim 2, wherein the quantity m is a function of the average difference of pressure $DP_{average}$ according to the following:

if $DP_{average}$<1 bar, then 8 g<m<12 g;

if 1 bar≤$DP_{average}$<2 bar, then 1 g<m<5 g; and if $DP_{average}$>2 bar, then −4 g<m<0.

4. The method according to claim 1, wherein the quantity m is a function of an average mass flowrate $DM_{average}$ of refrigerant during the loading of the amount of refrigerant B−x.

5. The method according to claim 4, wherein the quantity m is a function of the average mass flowrate $DM_{average}$ according to the following:

if $DM_{average}$<535 g/minute, then 8 g<m<12 g;

if 535 g/minute≤$DM_{average}$<1070 g/minute, then 1 g<m<5 g; and if $DM_{average}$≥1070 g/minute, then −4 g<m<0.

6. The method according to claim 1, wherein 20 g<x<80 g.

7. The method according to claim 1, wherein, before the loading step, the method further comprises a step of sending an amount $V_1$ of refrigerant in gaseous phase through the low pressure pipe towards the A/C system, in order to push the refrigerant in liquid phase present in the low pressure pipe toward the A/C system.

8. The method according to claim 1, wherein, after the loading step of refrigerant in the liquid phase, the method further comprises a step of sending an amount $V_2$ of refrigerant in gaseous phase through the high pressure pipe towards the A/C system, in order to push the refrigerant in liquid phase present in the high pressure pipe towards the A/C system.

* * * * *